US010731366B1

(12) United States Patent
Krombein

(10) Patent No.: US 10,731,366 B1
(45) Date of Patent: Aug. 4, 2020

(54) BEZEL OR INSERT FOR WATER SKIMMER

(71) Applicant: Todd Krombein, Phoenix, AZ (US)

(72) Inventor: Todd Krombein, Phoenix, AZ (US)

( * ) Notice: Subject to any disclaimer, the term of this patent is extended or adjusted under 35 U.S.C. 154(b) by 0 days.

(21) Appl. No.: 16/255,634

(22) Filed: Jan. 23, 2019

Related U.S. Application Data

(60) Provisional application No. 62/620,955, filed on Jan. 23, 2018, provisional application No. 62/746,420, filed on Oct. 16, 2018.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.1
See application file for complete search history.

(56) References Cited

U.S. PATENT DOCUMENTS

2004/0074831 A1* 4/2004 Mhoon ..... E04H 4/1272 210/167.19
2005/0000009 A1* 1/2005 Evans ..... E04H 4/1272 4/498
2007/0012607 A1* 1/2007 Mullner, Jr. ..... E04H 4/1272 210/167.1
2009/0020164 A1* 1/2009 Reed ..... E04H 4/1636 137/270

* cited by examiner

*Primary Examiner* — Fred Prince
(74) *Attorney, Agent, or Firm* — Knobbe Martens Olson & Bear LLP

(57) ABSTRACT

A bezel for inserting into an opening of a water skimmer installed in a wall of an artificial body of water are disclosed. The bezel forms an open-ended duct-like structure that allows water to pass into the skimmer. The visible surfaces of the bezel can have a color or texture that mimics the wall of the artificial body of water so as to conceal the skimmer. The bezel can include one or more ribs that extend from the outside surface of the bezel. The one or more ribs can be sized to form a friction fit that holds the bezel within the opening of the skimmer.

20 Claims, 18 Drawing Sheets

BEZEL OR INSERT FOR WATER SKIMMER

BACKGROUND

Field

The present disclosure generally relates to an insert or bezel for water skimmers that help maintain artificial bodies of water clean, and in particular, insert or bezel for water skimmers that help maintain a pool, spa, or the like clean while maintaining aesthetic appeal.

Description of the Related Art

Artificial bodies of water, such as pools, spas, fountains, ornamental ponds, utility ponds and the like, typically have filter systems that allow the water in the body of water to be filtered and cleaned. Typically, the water is removed from the artificial body of water via a drain and is pumped through a filtration or cleaning system. It is preferable that the water flows through the system as efficiently as possible. Pool or spa water skimmers are often used as part of a pool cleaning system to skim and capture floating debris on the water or sidewalls of a pool.

Water skimmers are often used as part of a pool cleaning system and are typically installed on the sidewalls of most swimming pools so that water can be removed from the pool, any debris in the water captured in the water skimmer, and the water circulated through a filtration system. The water skimmers generally extend through a sidewall of the pool and are connected to drain pipes that are configured to transport water from the pool to a filtering device. Furthermore, a recirculation pump is typically used to remove water from the pool through the water skimmer, down the drain pipes, and into the filtration system wherein the water is filtered and cleaned before being transported back into the pool through the return lines.

Conventional water skimmers are generally unsightly and can pose as a safety hazard for swimmers. A swimming pool tends to lose some of its aesthetic appeal when the sidewall of the pool is dotted with numerous water skimmers. Various water skimmers have been developed for safety of swimmers while at the same time enhancing the aesthetic appeal of the pool.

This Background is provided to introduce a brief context for the Summary and Detailed Description that follow. This Background is not intended to be viewed as limiting the claimed subject matter to implementations that solve any or all of the disadvantages or problems presented herein.

SUMMARY

In particular, the standard water skimmer currently used for most swimming pools is a rectangular assembly. The skimmer assembly is adapted to be positioned into a generally rectangular sidewall opening and comprises a main opening that serve as passage ways for water to flow from the pool into the water skimmer. Furthermore, the opening is made from plastic material and is generally available only in a limited number of colors.

Consequently, the standard water skimmers often do not match the surface finish of the swimming pool as the surface finish of the pools can be made from a wide variety of colors and textures. In particular, the standard water skimmers will appear conspicuously out of place when set against the surface finish of swimming pools wherein the color of the surface is custom blended to the taste of the pool owner.

Likewise, the standard water skimmers also appear undesirably conspicuous when they are positioned on sidewalls of spas that have a certain surface color.

From the foregoing, it will be appreciated that there is a need to make an insert or bezel for water skimmers in swimming pools or spas that are less conspicuous. To this end, there is a particular need for apparatuses and/or methods for matching a water skimmer assembly to the surrounding surface of the pool or spa.

In one embodiment, a bezel is provided for inserting into an opening of a water skimmer that is installed in a wall of an artificial body of water. The bezel includes a first wall, a second wall, a third wall, a fourth wall, and a first rib. The first, second, third, and fourth walls are arranged to form an open-ended duct-like structure. Each of the first, second, third, and fourth walls has an inside surface that faces toward a central opening of the duct-like structure. The first rib is disposed on an outside surface of the first wall. The first rib extends a length along a direction from a front edge of the first wall to a rear edge of the first wall. The first rib extends a height away from the outside surface of the first wall. The height of the rib increases along the direction.

In another embodiment, the bezel includes a floor, a first sidewall, and a second sidewall. The floor has a front edge, a back edge, a first lateral edge, and a second lateral edge. The first and second lateral edges connect the front edge to the back edge. The first sidewall extends in a first direction from the first lateral edge. The second sidewall extends in the first direction from the second lateral edge. The second sidewall includes an inside surface that faces toward an inside surface of the first sidewall. The floor includes an inside surface that faces toward the first direction. The inside surfaces of the first sidewall, the second sidewall, and the floor has a color or a texture that mimics a surface of the wall of the artificial body of water.

BRIEF DESCRIPTION OF THE DRAWINGS

The features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1:
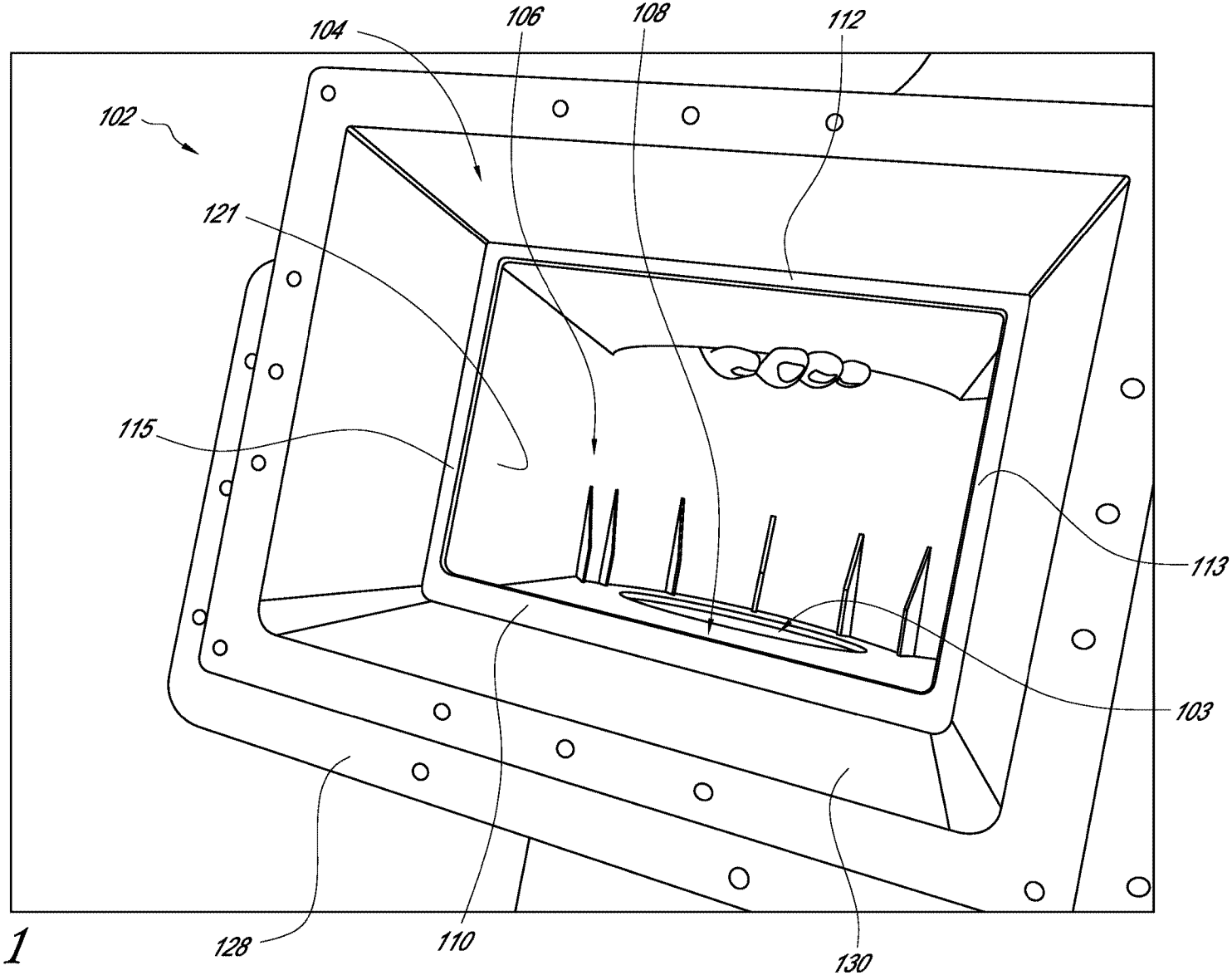
FIG. 1 illustrates a front view of an embodiment of a water skimmer.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure.

FIG. 1 illustrates a front view of an embodiment of a water skimmer 102. The water skimmer or surface skimmer 102 may be installed in a wall or sidewall of an artificial body of water such as a pool or spa (e.g., a pool can have a pool skimmer). The water skimmer 102 can help clean by skimming water and capturing floating debris like leaves, flower petals, dirt, twigs, dead insects, and oil (sunblock) before the waste can sink to the bottom of the pool. The water skimmer 102 can be built into the upper sides of an in-ground pool, where the suction draws debris and traps it. The water skimmer 102 may be accessed via the pool deck area through a trap door or hatch. The water skimmer 102 may also be in a convenient location to attach a suction line for a pool vacuum. The water skimmer 102 is typically made of plastic (or PVC) or precast concrete.

The water skimmer 102 can have an opening 104 for taking in water. The water skimmer 102 can have an outlet 103 for providing a flow path to allow water within the skimmer 102 to enter a piping system of a filtration circuit (not shown). The opening 104 can lead to a throat 106 that is disposed between the opening 104 and the outlet 103. The opening 104 may lead to a throat 106 that leads to a tank connected to the pool vacuum. The opening 104 and the throat may 106 be connected by a lip 108. The lip 108 may be or have a flange that provides the connection and transition from the opening 104 to the throat 106.

The lip 108 can have different flanges connecting the different parts of the opening 104 and the throat 106. For example, the lip 108 can include a bottom flange 110, an opposing top flange 112, a first lateral flange 113 that connects the bottom flange 110 to the top flange 112, and a second lateral flange 115 that connects the bottom flange 110 to the top flange 112. In some arrangements, the lip 108 can include some but not all of the aforementioned flanges. For example, the lip 108 can include the first lateral flange 113, the second lateral flange 115, and the top flange 112, and not include the bottom flange 110.

In some arrangements, each of the flanges has approximately the same width, as shown in FIG. 1, where the width dimension is the extent to which the flange extends from the inner surface of the skimmer 102 toward a central axis of the opening 104. In certain arrangements, one or more of the flanges of the lip 108 can have a width that is different from that of another flange of the lip 108. As discussed herein, the bezel or insert of the present disclosure can be adapted to fit within different arrangements of the lip 108.

As shown in the illustrated embodiment, the lip 108 may have a bottom flange 110 that extends a predetermined distance from the opening 104 (e.g., a surface of the opening) into the water skimmer 102. The bottom flange 110 can extend inwardly toward a central axis of the water skimmer 102. The bottom flange 110 may extend substantially perpendicular to the central axis, a surface of the opening 104, and/or a surface of the throat 106. The water skimmer 102 may also have a top flange 112 that extends a predetermined distance from the opening 104 (e.g., a surface of the opening) into the water skimmer 102. The top flange 112 can extend inwardly toward a central axis of the water skimmer 102. The top flange 112 may extend substantially perpendicular to the central axis, a surface of the opening 104, and/or a surface of the throat 106. The top flange 112 may extend a predetermined distance into the opening 104 that is less the than the predetermined distance that the bottom flange 110 extends. The top flange 112 may extend a predetermined distance into the opening 104 that is more the than the predetermined distance that the bottom flange 110 extends. Each of the first and second lateral flanges 113, 115 may extend substantially perpendicular to the central axis, a surface of the opening 104, and/or a surface of the throat 106. Each of the first and second lateral flanges 113, 115 may extend a predetermined distance into the opening 104 that is less the than the predetermined distance that the bottom flange 110 extends. Each of the first and second lateral flanges 113, 115 may extend a predetermined distance into the opening 104 that is more the than the predetermined distance that the bottom flange 110 extends. The first lateral flange 113 may extend the same distance, a greater distance, or a lesser distance into the opening 104 as compared to the second lateral flange 115.

Figure 2:
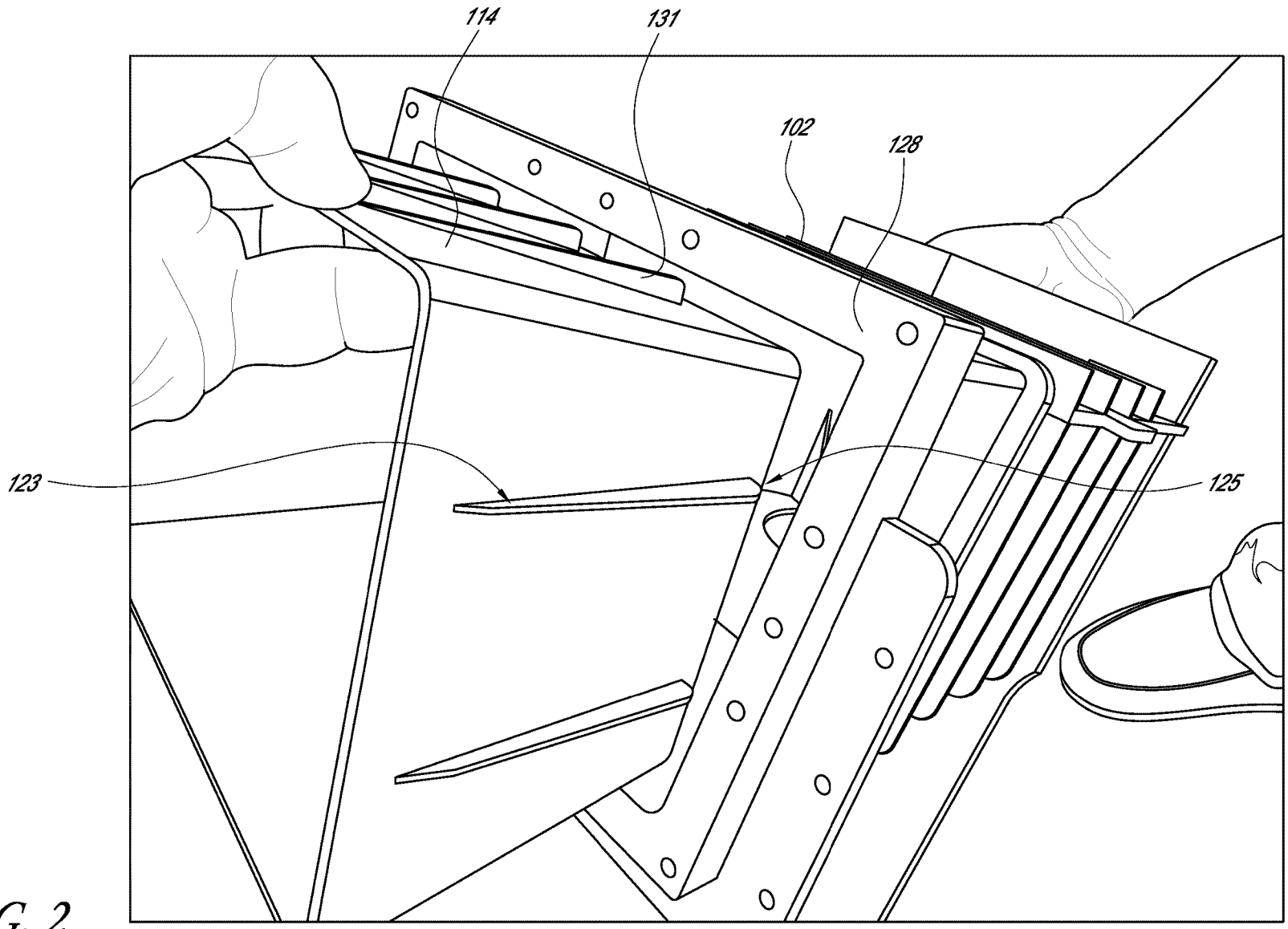
FIG. 2 illustrates a top side view of an embodiment of a bezel being inserted into a water skimmer.
Figure 3:
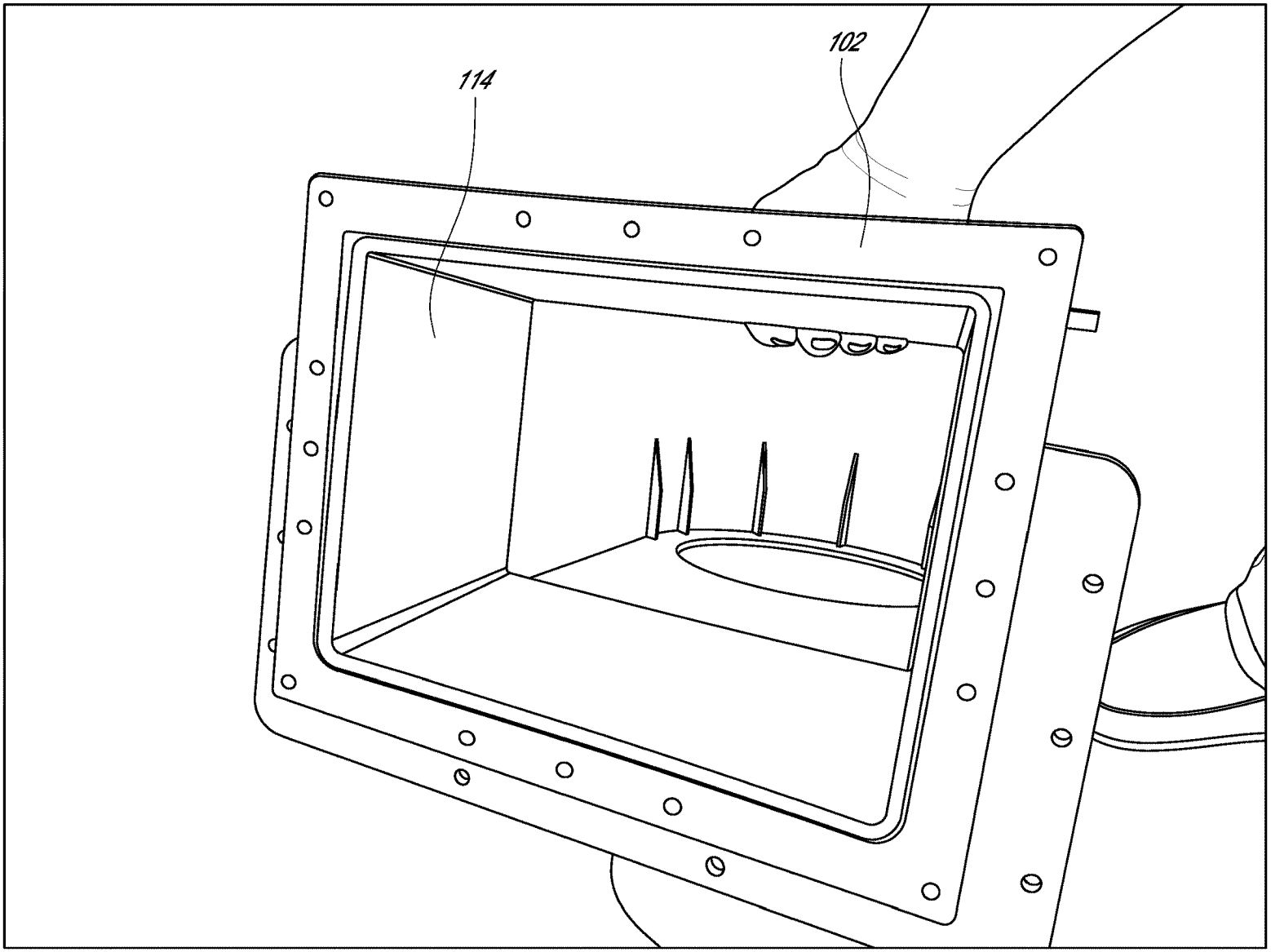
FIG. 3 illustrates a top side view of an embodiment of a bezel inserted into a water skimmer.

FIG. 2 illustrates a top side view of an embodiment of a bezel or insert 114 (or bezel insert) being inserted into a water skimmer 102. FIG. 3 illustrates a top side view of an embodiment of a bezel 114 inserted into the water skimmer 102. The bezel 114 can be made of any suit suitable material such as vinyl, including polyvinyl chloride (PVC), and/or any other suitable plastic and/or rubber. The bezel 114 can come in any variety of colors or textures to match and/or mimic the surface of the containing artificial body of water. For example, the bezel 114 can be made to match a sidewall and/or deck of a pool or spa. The bezel 114 can be interchangeable or be changed as needed between various types water skimmers 102 and/or based on the manufacturer of the water skimmer 102.

As illustrated in FIG. 3, the bezel 114 can taper inwards towards the throat 106. For example, the bezel 114 may extend inwards at an angle from the opening 104 to the throat 106 such that the bezel portion in contact with the throat 106 is substantially flush to the surfaces of the throat 106 at the lip 108. Accordingly, the bezel 114 may not only provide a smooth flow path for the water from the opening 104 to the throat 106, but also substantially cover major surfaces of the opening 104 and/or lip 108.

Figure 4:
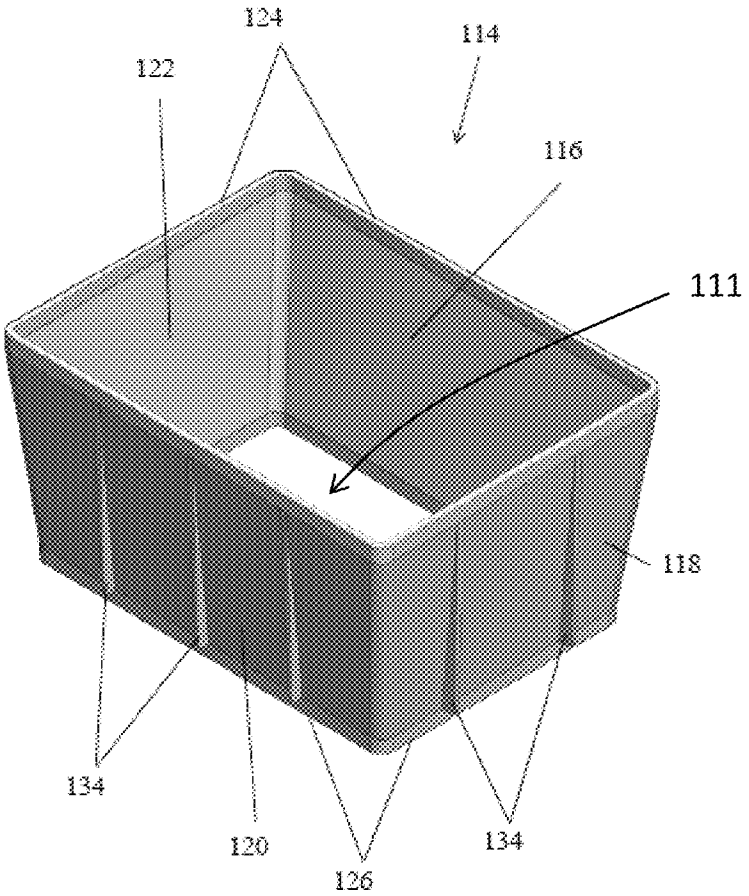
FIG. 4 illustrates a top, front, first side, isometric view of an embodiment of a bezel.
Figure 5:
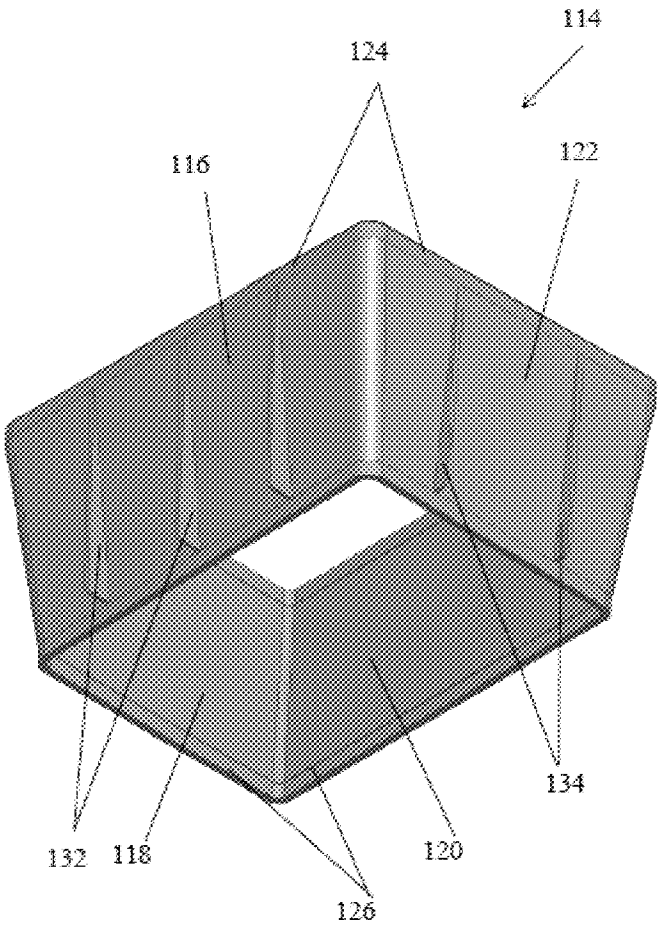
FIG. 5 illustrates a bottom, back, second side, isometric view of an embodiment of a bezel.

FIG. 4 illustrates a top, front, first side, isometric view of an embodiment of a bezel 114. FIG. 5 illustrates a bottom, back, second side, isometric view of an embodiment of a bezel 114. As illustrated in the figures, the bezel 114 can have a first surface or wall 116, a second surface or wall 118, a third surface or wall 120, and a fourth surface or wall 122. The four walls of the bezel 114 may be connected in a rectangular shape. As shown in FIG. 4, the four walls 116, 118, 120, 122 can define a duct-like structure that is framed by the four walls 116, 118, 120, 122 and open on each of the two opposing ends. The inside surfaces of the four walls 116, 118, 120, 122 can define a central opening 111 of the duct-like structure. Water can enter the skimmer 102 by flowing along the central opening 111 defined by the inside surface of the four walls of the bezel 114. Other suitable shapes may be used to match other shapes of water skimmers 102. The four walls of the bezel 114 may be connected by four respective corners.

Figure 6:
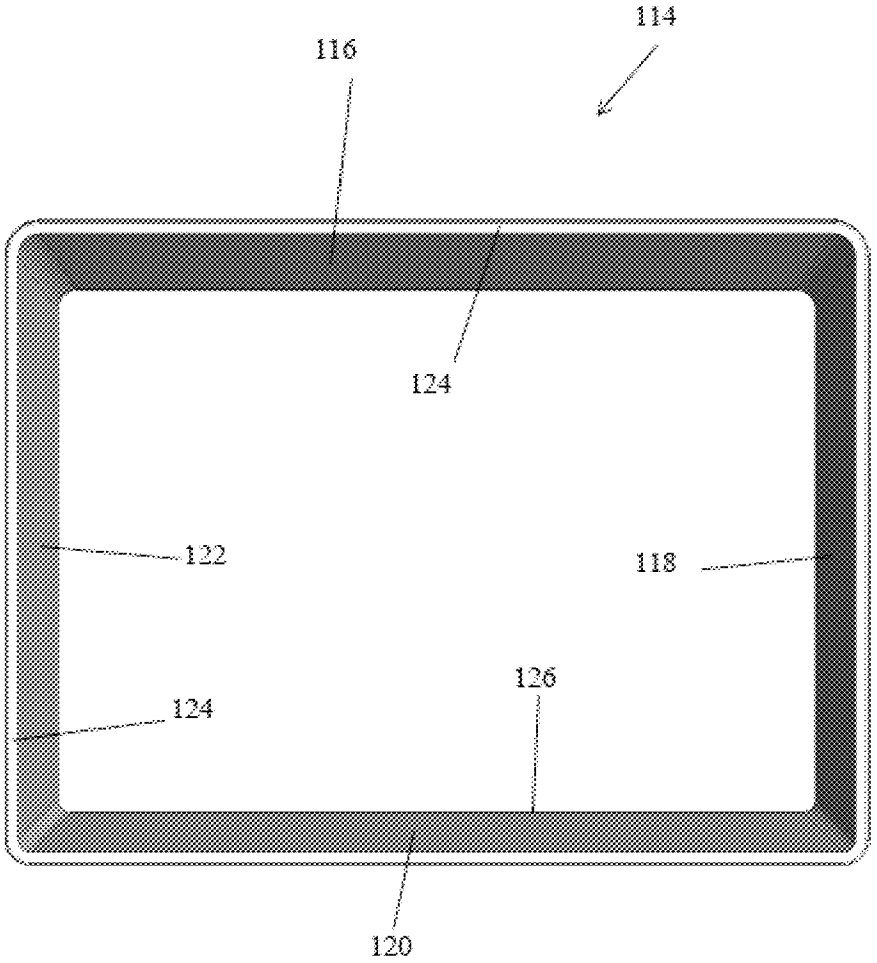
FIG. 6 illustrates a top view of an embodiment of a bezel.
Figure 7:
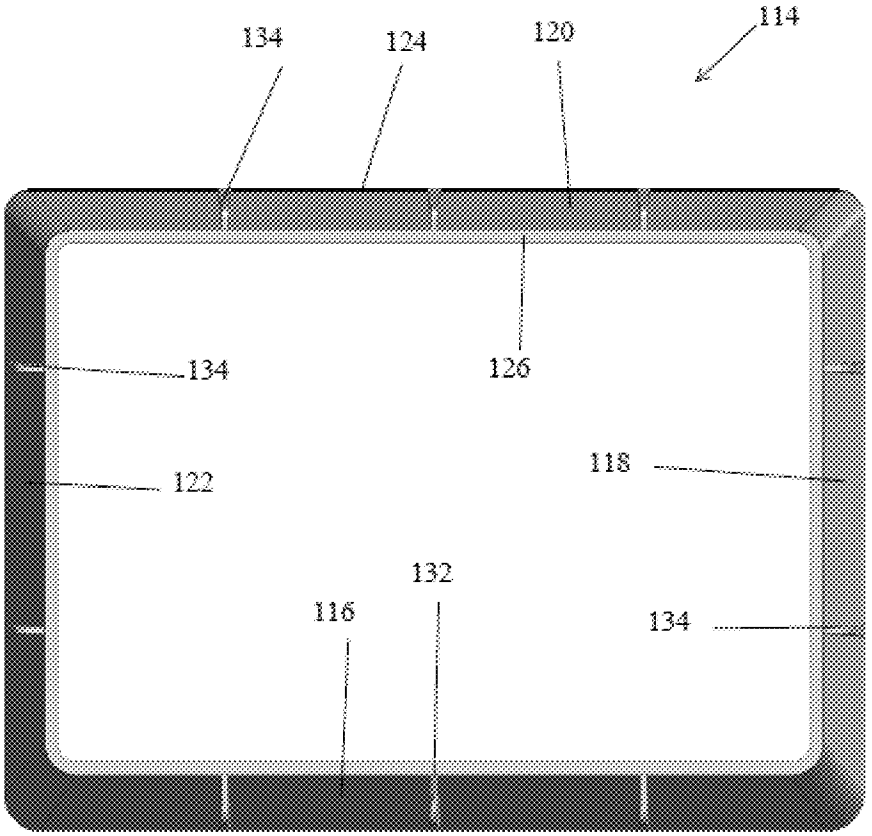
FIG. 7 illustrates a bottom view of an embodiment of a bezel.

FIG. 6 illustrates a front view of an embodiment of a bezel 114. FIG. 7 illustrates a rear view of an embodiment of a bezel 114. As illustrated in the figures, the bezel 114 can have a front edge 124 and rear edge 126. The front edge 124 can have dimensions and be sized to match and be substantially flush with the outer surfaces 128 (FIG. 1) of the water skimmer 102. For example, the front edge 124 can come in direct contact with the inner surface 130 (FIG. 1) that connects to the outer surfaces 128 of the water skimmer 102 (e.g., near, proximate, or at the connection between these two surfaces) and have an extent up to the outer surfaces 128 of the water skimmer 102.

The rear edge 126 can have dimensions to match and be substantially flush with the surfaces of the throat 106 of the water skimmer 102. The rear edge 126 can come in contact with and directly be positioned on the surfaces of the lip 108 (e.g., the flanges). The rear edge 126 can have dimensions and be sized to match and be substantially flush with the surfaces of the throat 106 of the water skimmer 102. For example, the rear edge 126 can come in direct contact with adjacent surfaces of the lip 108 and have an extent up to the inner surfaces 121 (FIG. 1) of the throat 106.

Figure 8:
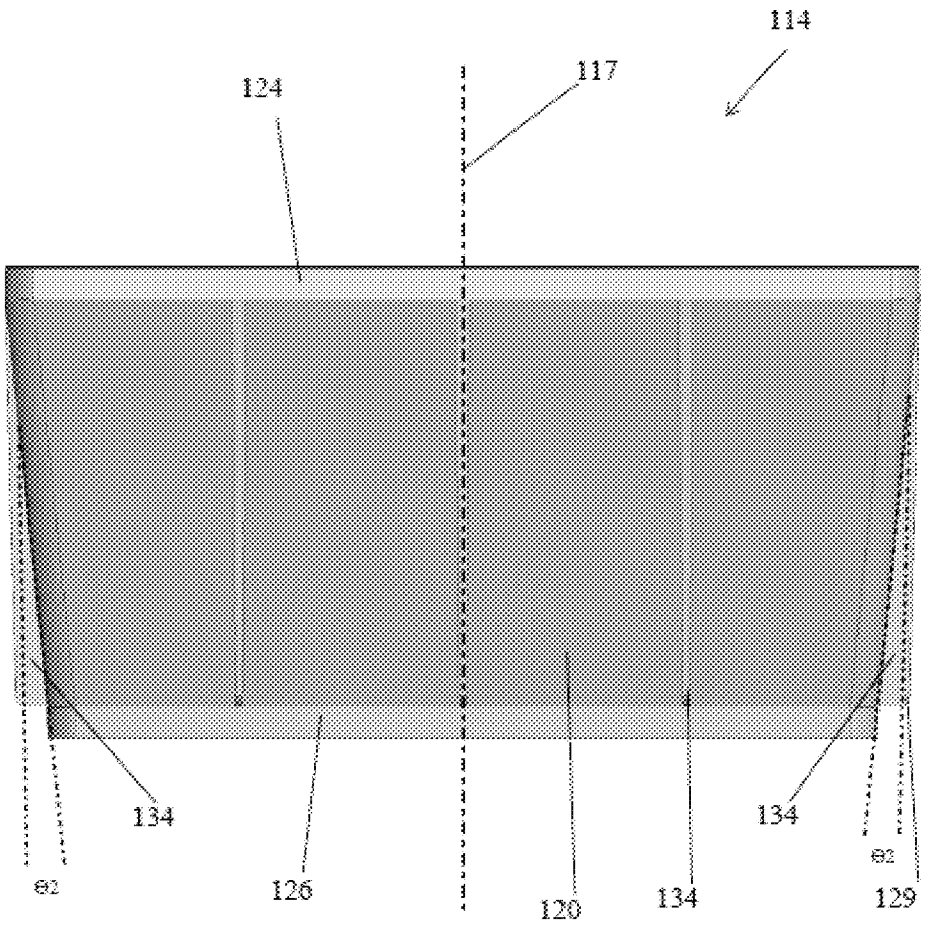
FIG. 8 illustrates a front view of an embodiment of a bezel.
Figure 9:
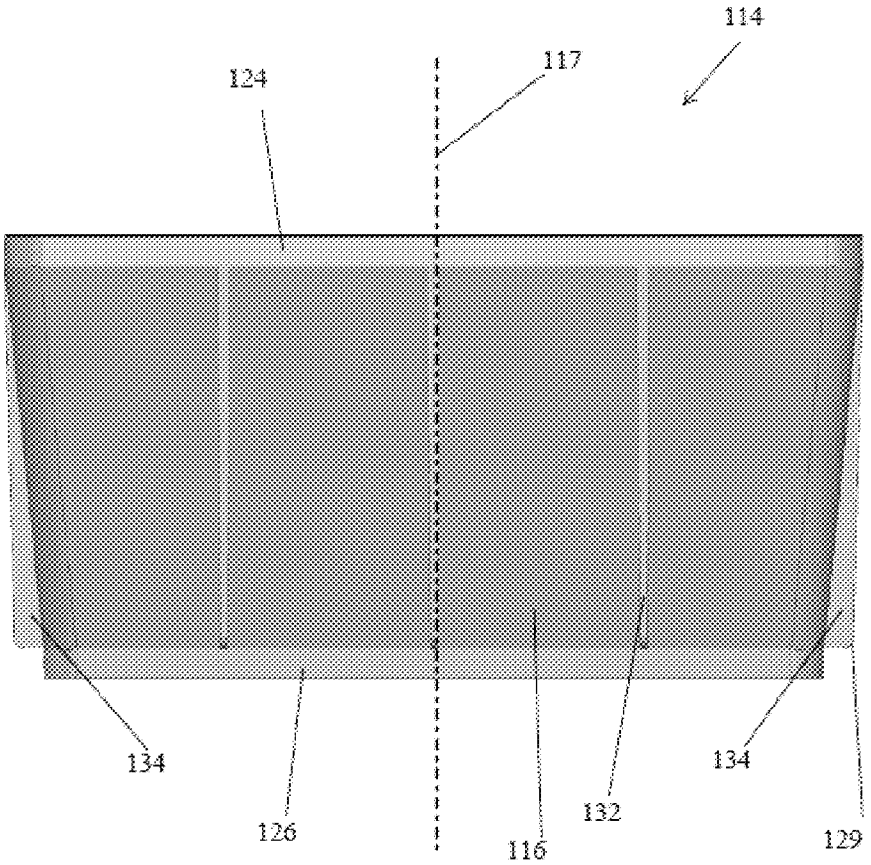
FIG. 9 illustrates a back view of an embodiment of a bezel.
Figure 10:
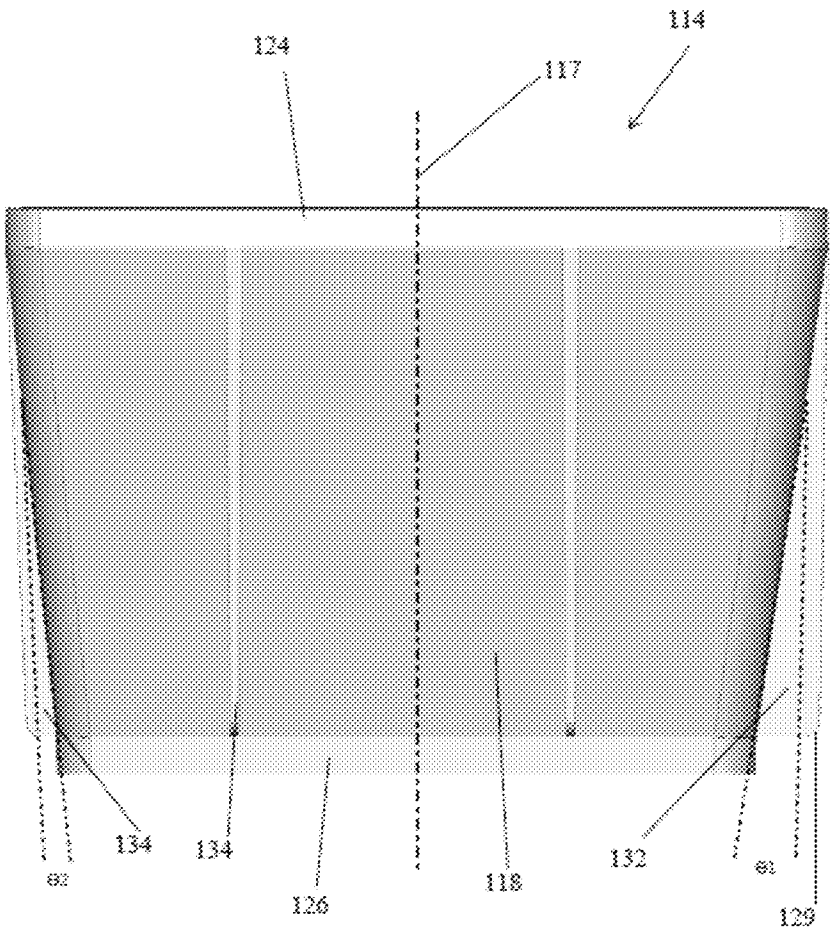
FIG. 10 illustrates a first side view of an embodiment of a bezel.
Figure 11:
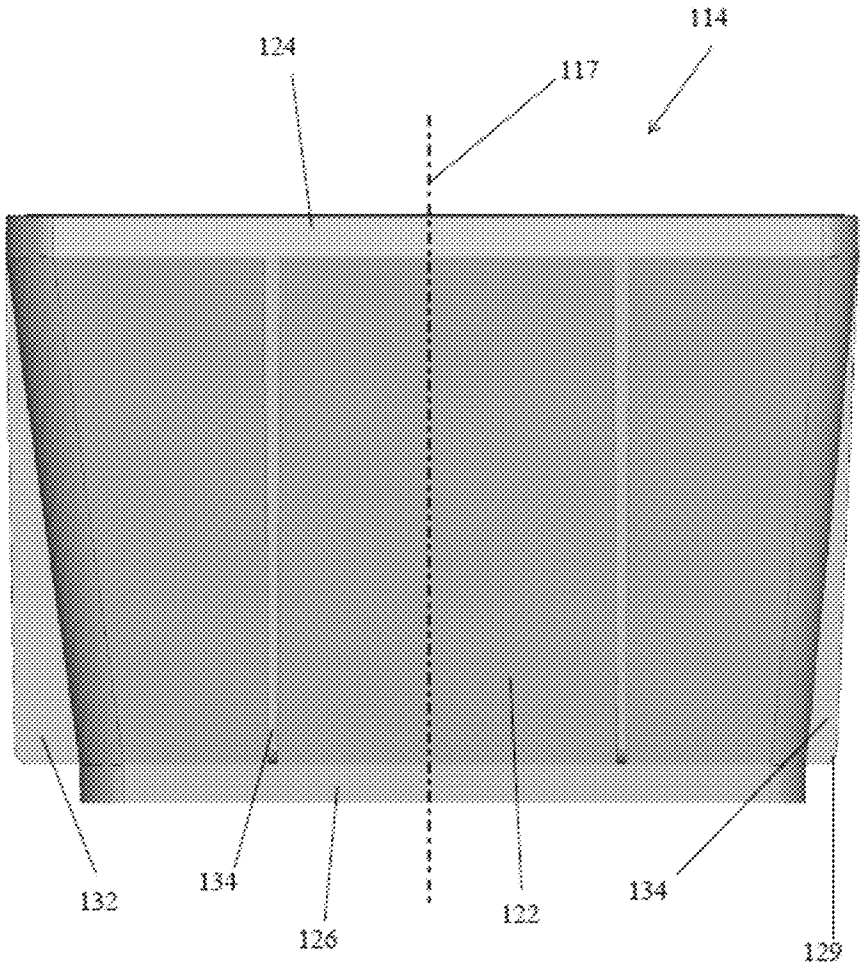
FIG. 11 illustrates a second side view of an embodiment of a bezel.

FIG. 8 illustrates a bottom view of an embodiment of a bezel 114. FIG. 9 illustrates a top view of an embodiment of a bezel 114. FIG. 10 illustrates a first side view of an embodiment of a bezel 114. FIG. 11 illustrates a second side view of an embodiment of a bezel 114. As illustrated in FIG. 10, the first wall 116 of the bezel 114 can extend at a predetermined angle θ1 relative to the central axis 117. The first wall 116 can taper inwards towards the central axis 117 from the front edge 124 to the rear edge 126. The predetermined angle θ1 of the first wall 116 can be such that the rear edge 116 matches to and/or contacts the surfaces of the throat 106 and lip 108 as discussed herein.

As illustrated in FIGS. 8 and 10, the second, third, and/or fourth walls 118, 120, 122 of the bezel 114 can extend at a predetermined angle θ2 relative to the central axis 117. The second, third, and/or fourth walls 118, 120, 122 can taper inwards towards the central axis 117 from the front edge 124 to the rear edge 126. The predetermined angle θ2 of the second, third, and/or fourth walls 118, 120, 122 can be such that the rear edge 126 matches and/or contacts the inner surfaces of the throat 106 and lip 108 as discussed herein.

In some embodiments, the first wall 116 may also extend at the predetermined angle θ2 relative to the central axis 117 depending on the extent of the bottom flange 110. In some embodiments, any one of the second, third, and/or fourth walls 118, 120, 122 can extend at the predetermined angle θ1 relative to the central axis 117 depending on the extent of the top flange 112 or the first or second lateral flanges 113, 115. In some embodiments, two of the walls of the bezel 114 may extend at the same predetermined angle. In some embodiments, four or all of the walls may extend at the same predetermined angle (e.g., all extending at either angle θ1 or θ2). In some embodiments, the predetermined angle θ1 can be 5 to 45°, including the foregoing values and ranges bordering therein. In some embodiments, the predetermined angle θ2 can be 2 to 35°, including the foregoing values and ranges bordering therein.

As illustrated in the figures, the bezel 114 can have a plurality of ribs 131 (FIG. 2) connected to the walls to position the bezel 114 within the water skimmer 102 as discussed herein. The ribs 131 can have a leading edge 123 (FIG. 2) that faces toward the front edge 124 of the bezel 114. The ribs 131 can have a trailing edge 125 that faces toward the rear edge 126 of the bezel 114. The ribs 131 may extend a greater distance or have an increasing dimension from the front edge 124 to the rear edge 126 depending on the predetermined angle of the walls relative to the central axis 117 as discussed herein.

For example, the portion of the rib 131 near the front edge 124 of the bezel 114 may be substantially flush with the outer surface of the first wall 116 at the front edge 124. The top portion or uppermost portion of the rib 131 may begin or extend from the front edge 124 such that the uppermost point of the rib 131 has a surface that is substantially flush and parallel to the front edge 124 and/or immediately adjacent surfaces of the walls of the bezel 114. As the rib 131 extends further away from its respective wall along the central axis 117 from the front edge 124 to the rear edge 126, the rib 131 extends relatively further away from the surface of the respective wall. The rib 131 may terminate near, approximate, and/or at the rear edge 126 at its greatest extent (e.g., a dimension perpendicular to the central axis) from the surface of the respective wall perpendicular to the central axis 117.

As illustrated in, for example FIGS. 8-11, the ribs 131 may have a rounded edge or corner near 129 the bottom edge of the bezel 114. The rounded edge 129 can help facilitate insertion of the bezel 114 into the water skimmer 102 and/or accommodate fillets (e.g., rounded fillets or raised corners) of the connection between the opening 104 and the lip 108 of the water skimmer 102.

The ribs 131 may extend a predetermined distance perpendicular to a central axis 117 of the bezel 114 such that the ribs 131 are in contact with the inner surfaces 130 of the opening 104 to position the bezel 114 within the opening 104. For example, the ribs 131 may have a smaller extent or dimension perpendicular to the central axis 117 proximate, near, or at the front edge 124 relative to an extent or dimension perpendicular to the central axis 117 proximate, near, or at the rear edge 126. Accordingly, the ribs 131 may be sized and shaped to accommodate the taper of the bezel 114 from the front edge 124 to the rear edge 126 as discussed herein (e.g., from the outer surfaces 128 of the opening 104 to the inner surfaces 121 of the throat 106 at the lip 108) while maintaining contact with the inner surfaces 130 of the opening 104 to securely position the bezel 114 within the water skimmer 102 at a predetermined and/or desired position.

As illustrated in the figures and discussed herein, the bezel 114 can have a first set 132 (FIG. 5) of the plurality of ribs 131 that have a greater extent perpendicular to the central axis 117 near, proximate, and/or at the rear edge 126 relative to a second set 134 of the plurality of ribs 131 of the bezel 114. As discussed herein, the different extents of the plurality of ribs 131 can accommodate different predetermined tapering angles of the walls of the bezel 114 while maintaining contact with the inner surfaces 130 of the opening 104 to position and secure the bezel 114 in the opening 104 of the water skimmer 102.

For example, outermost surfaces or edges of the ribs 131 can be substantially in direct contact with the inner surfaces 130 of the opening 104 throughout the extent of the ribs 131 along the central axis 117 and/or the front edge 124 to the rear edge 126. The outermost surfaces or edges of the ribs 131 can extend parallel or along the inner surfaces 130 of the opening 104. In some arrangements, the outermost surfaces or edges of the ribs 131 can extend at a tapering angle relative to the central axis 117. For example, the outermost surfaces of the ribs 131 can extend at a predetermined tapering angle that is less than the predetermined angles θ1 and θ2 discussed herein. As shown in FIG. 8, the increase in the height of the rib 131 can equal or substantially match the taper of the wall such that in some embodiments, the outermost surfaces of the ribs 131 can extend substantially parallel to the central axis 117. As illustrated in the figures, the first wall 116 can have the first set 132 of the plurality of ribs 131. The second, third, and/or fourth walls 118, 120, 122 can have a second set 134 of the plurality of ribs 131 having an extent or dimension that is less than the first set 132 of the plurality of ribs 131 near, proximate, and/or at the rear edge 126.

In some embodiments, any one of the second, third, and/or fourth walls 118, 120, 122 can have the first set 132 of the plurality of ribs. In some embodiments, two of the walls of the bezel 114 may have the first set 132 of the plurality of ribs 131. In some embodiments, two of the walls of the bezel 114 may have the second set 134 of the plurality of ribs. In some embodiments, four or all of the walls may have the first set 132 of the plurality of ribs 131. In some embodiments, four or all of the walls may have the second set 134 of the plurality of ribs 131.

Figure 12:
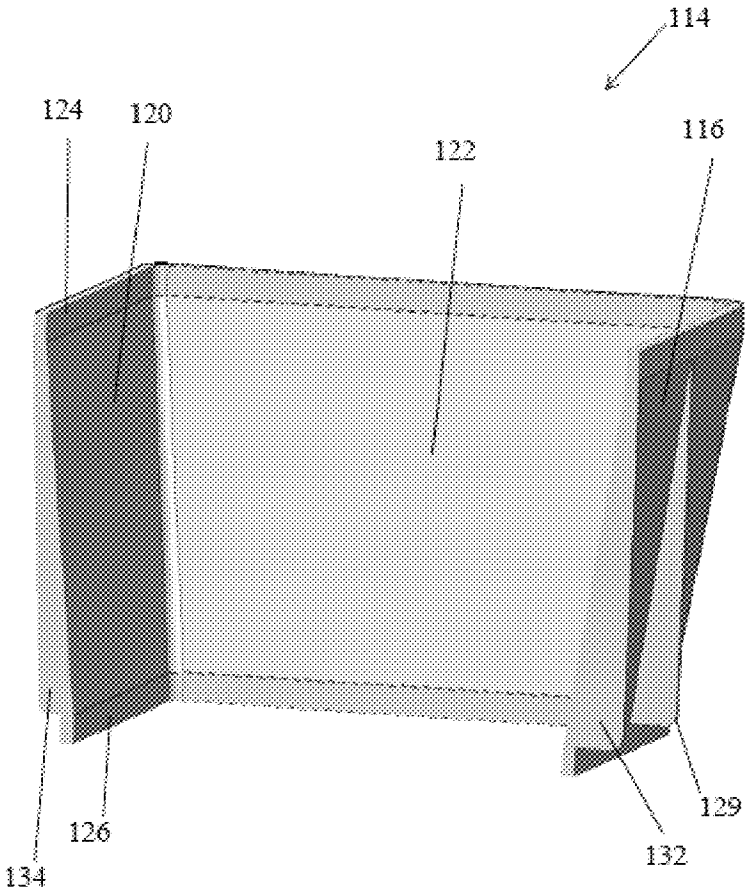
FIG. 12 illustrates a top, back, isometric, first side cross-sectional view of an embodiment of a bezel.
Figure 13:
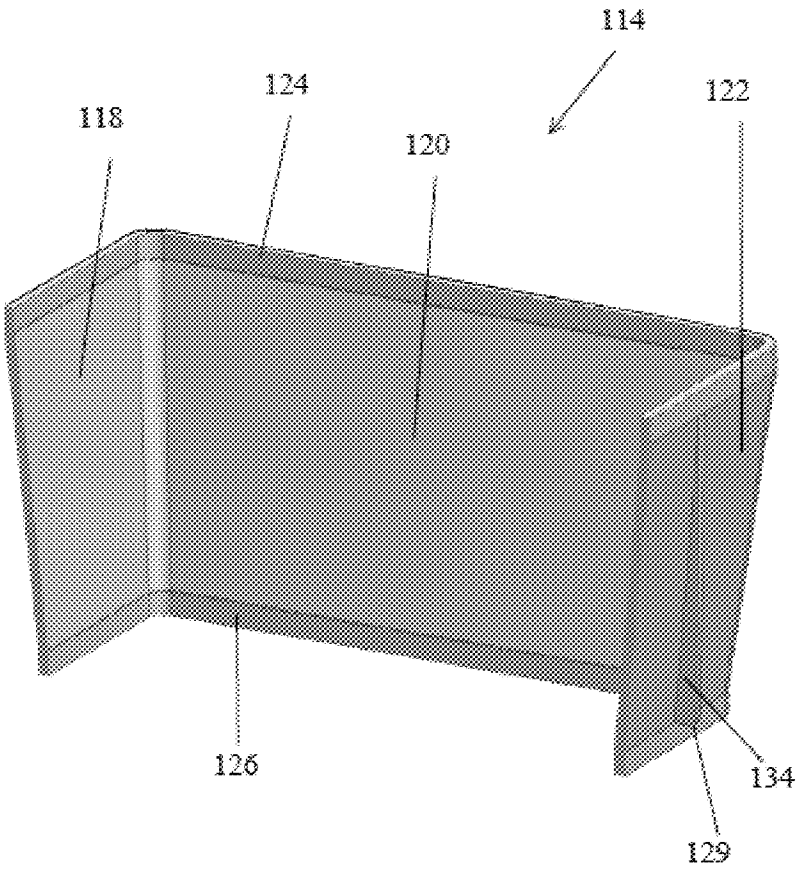
FIG. 13 illustrates a top, second side, isometric, back cross-sectional view of an embodiment of a bezel.

FIG. 12 illustrates a top, back, isometric, first side cross-sectional view of an embodiment of a bezel 114. FIG. 13 illustrates a top, second side, isometric, back cross-sectional view of an embodiment of a bezel 114. FIGS. 12 and 13 further illustrate the concepts discussed herein. For example, FIG. 12 illustrates the greater extent of the first set 132 of ribs 131 relative to the second set 134 of ribs 131 near the rear edge 126. FIG. 13 illustrates the walls tapering at a predetermined angle relative to the central axis 117 from the front edge 124 to the rear edge 126 at a relatively constant angle and constant thickness of the walls.

As illustrated in, for example FIGS. 8-13, the front edge 124 and/or the rear edge 126 may extend a certain or predetermined distance along the central axis 117 at an angle different than the predetermined angles θ1 and θ2 discussed herein for the walls. For example, the front edge 124 and/or the rear edge 126 may extend substantially parallel to the central axis 117 from their respective connections to the walls of the bezel 114. In some embodiments, the front edge 124 and/or the rear edge 126 may extend at a predetermined angle that is different than the predetermined angles θ1 and θ2 discussed herein. In some embodiments, the front edge 124 and/or the rear edge 126 may extend at a similar angle as any one of the walls, such as for example at predetermined angles θ1 and θ2. As illustrated in the figures, the front edge 124 and/or the rear edge 126 may have a substantially same thickness as anyone of the walls of the bezel 114.

Figure 14:
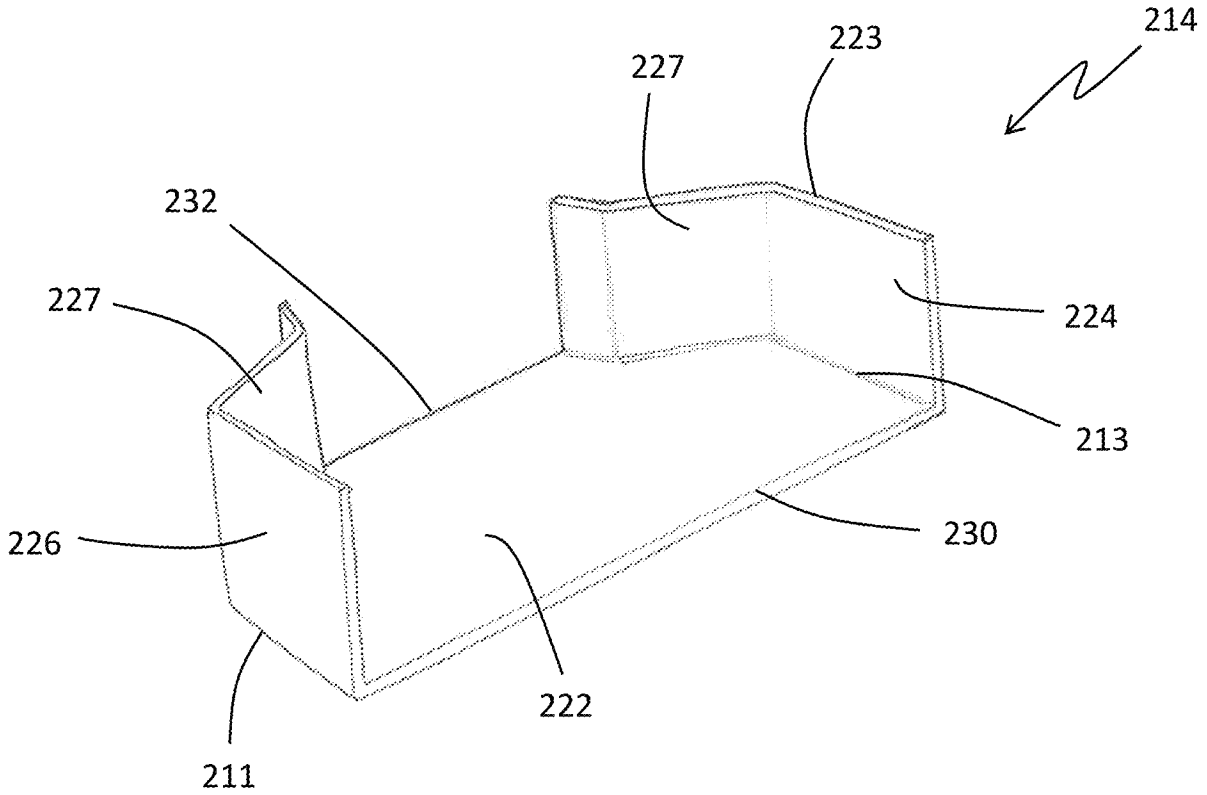
FIG. 14 illustrates a top perspective view of an embodiment of a bezel insert.

FIG. 14 illustrates a partial front and top side view of an embodiment of a bezel 214 of the present disclosure. The bezel 214 is similar to the bezel 114 except as described differently below. The features of the bezel 214 can be combined or included with the bezel 114 or any other embodiment discussed herein. The bezel 214 can be made of any suit suitable material such as vinyl, including polyvinyl chloride (PVC), or any other suitable plastic or rubber. The bezel 214 can come in any variety of colors or textures to match or mimic the surface of the artificial body of water into which the bezel 214 is installed. For example, the bezel 214 can be made to match a sidewall or deck of a pool or spa. The bezel 214 can be interchangeable and can be adapted as needed to fit within various types or models of water skimmers, as described herein.

As shown in FIG. 14, the bezel 214 can include a floor 222, a first sidewall 224, and a second side wall 226. The first and second sidewalls 224, 226 can extend from the floor 222, as shown in FIG. 14. In the illustrated embodiment, the first and second sidewalls 224, 226 are disposed opposite one another along opposite lateral edges of the floor 222, and each sidewall 224, 226 extends from a front edge 230 of the floor 222 to a back edge 232 of the floor 222. As shown in FIG. 14, the opposing lateral edges 211, 213 of the floor 220 connect the front edge 230 and the back edge 232 to one another. In use, the bezel 214 is positioned in the opening 104 (FIG. 1) of the skimmer 102 such that the back edge 232 is positioned between the outlet 103 (FIG. 1) of the skimmer 102 and the front edge 230 of the bezel 214. In the illustrated embodiment, the first and second sidewalls 224, 226 narrow toward one another as the sidewalls 224, 226 extend to the back edge 232 of the floor 222. In other words, the distance between the sidewalls 224, 226 can be greater at the front edge 230 than at the back edge 232. The inside surfaces of the sidewalls 224, 226 and the inside surface of the floor 222 can have a color or a texture that mimics the surface of the wall of the artificial body of water so that the bezel 214 blends in with the wall of the artificial body of water.

With continued reference to FIG. 14, the sidewalls 224, 226 can each include an angled portion 227. The angled portion 227 can allow the bezel 214 to be used with different models or shapes of skimmers 102. For example, the angled portion 227 can enable the bezel 214 to accommodate skimmers 102 that have differently shaped lips 108 (FIG. 1). As shown in FIG. 14, the sidewalls 224, 226 can be mirror images of one another. In some embodiments, the sidewalls 224, 226 have a form of a continuous curve (e.g., S-shaped) rather than the depicted Z-shaped form. The bezel 214 can be sized so that the back edge 232 is substantially flush with the surfaces of the throat 106 of the water skimmer 102. In some embodiments, the back edge 232 can come in contact with and directly be positioned on the surfaces of the lip 108 (FIG. 1). The top edge 223 of the sidewalls 224, 226 can be sized to match and be substantially flush with the surfaces of the throat 106 of the water skimmer 102. For example, the top edge 223 can come in direct contact with adjacent surfaces of the outer surfaces 128 (FIG. 1) and have an extent up to the outer surfaces 128 of the water skimmer 102.

Figure 15:
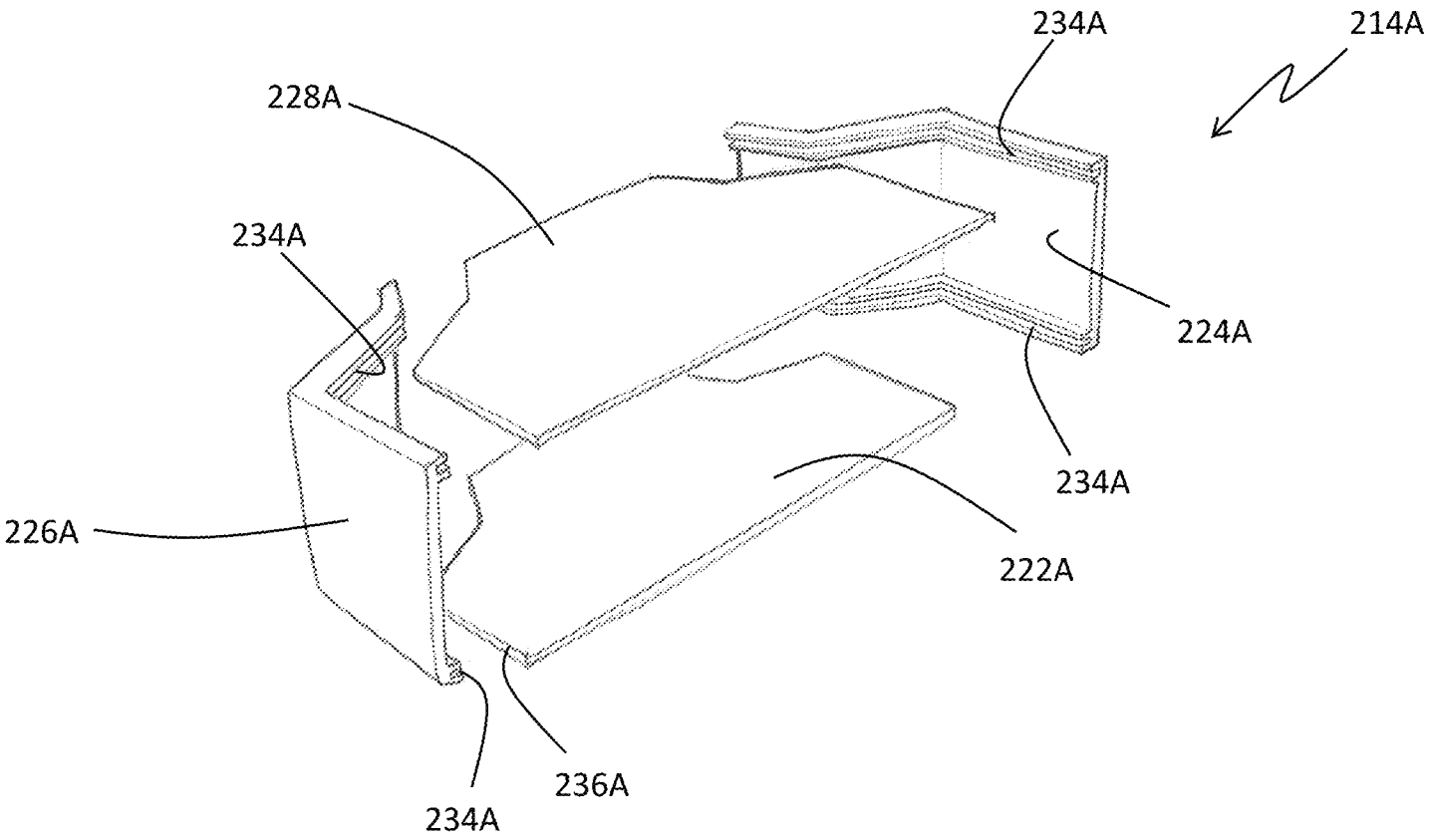
FIG. 15 illustrates a top perspective view of an embodiment of a bezel insert.

FIG. 15 illustrates an embodiment of the bezel 214A that is similar to the bezel 214 except as differently described herein. The bezel 214A can include a top slab 228A that is disposed opposite the floor 222A. The inside surface of the top slab 228A can face the floor 222A and have a color or a texture that mimics the wall of the artificial body of water, as discussed herein. The sidewalls 224A, 226A can include one or more rails 234A. The rails 234A can be sized to receive a lateral edge 236A of the floor 222A or top slab 228A. In some embodiments, the rails 234A facilitate assembly of the bezel 214A. In some embodiments, the bezel 214A can be assembled outside of the skimmer 102, and then the assembled bezel 214A can be inserted into the skimmer 102. In some embodiments, the bezel 214A is assembled within the skimmer 102. The rails 234A can facilitate the disassembly of the bezel 214A such that the bezel 214A can be removed from the skimmer 102 and a different bezel 214A (e.g., a different color bezel 214A) can be inserted into the skimmer 102. The bezel 214A can allow customization of the color or appearance of the bezel 214A in that different sidewalls 224A, 226A can be combined with different top slabs 228A and different floors 222A. In some embodiments, an adhesive is used to secure the floor 222A or the top slab 228A to the rails 234A. In some embodiments, the floor 222A or the top slab 228A are secured to the rails by a friction fit and an adhesive is not used to secure the floor 222A or the top slab 228A into the rails 234A.

Figure 16:
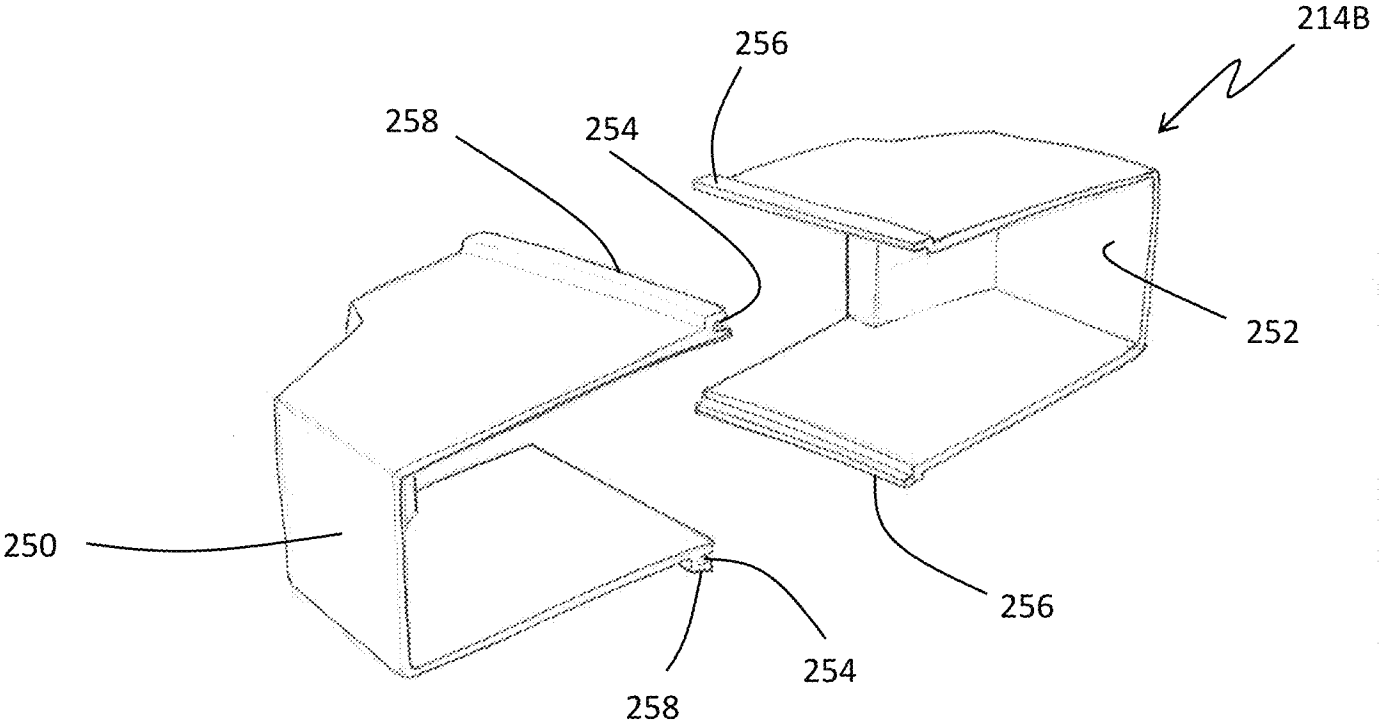
FIG. 16 illustrates a top perspective view of an embodiment of a bezel insert.

FIG. 16 illustrates an embodiment of the bezel 214B that is similar to the bezel 214A except as differently described herein. The bezel 214B can include a first side portion 250 and a second side portion 252. The first and second side portions 250, 252 can be adapted to join with one another. In the illustrated embodiment, the first side portion 250 includes a slot 254 that is sized to receive a tab feature 256 of the second side portion 252. The tab feature 256 can be secured to the slot 254 by friction fit or adhesive or a fastener (e.g., screw). The bezel 214B can be adapted so that when the tab feature 256 is secured in the slot 254 the inner surface of the bezel 214B is substantially smooth. The slot 254 can form a protrusion 258 on the outer surface of the bezel 214B, as shown in FIG. 16. The protrusion 258 can be sized to help keep the bezel 214B within the opening 104 of the skimmer 102 (FIG. 1). The bezel 214B can be flexible and can be squeezed to fit within the opening 104 of the skimmer 102. Once seated in the skimmer 102, the bezel 214B can elastically recoil such that the protrusion 258 is forced against the inner surface of the skimmer 102 to form a friction fit that holds the bezel 214B within the opening 104 of the skimmer 102.

Figure 17:
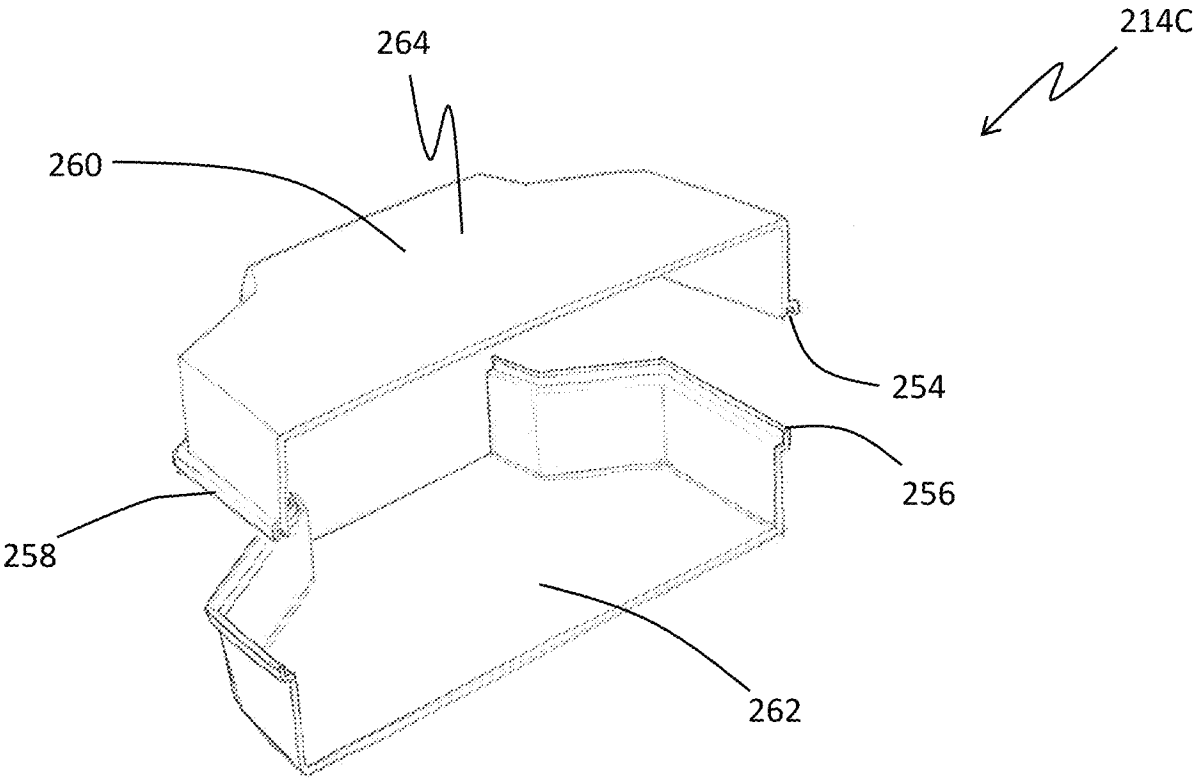
FIG. 17 illustrates a top perspective view of an embodiment of a bezel insert.

FIG. 17 illustrates an embodiment of the bezel 214C that is similar to the bezel 214B except as differently described herein. The bezel 214C can include a top portion 260 and a bottom portion 262. The top portion 260 can include a slot 254 that receives a tab feature 256 of the bottom portion 262 to secure the top portion 260 and the bottom portion 262 to one another, as described previously. In the illustrated embodiment, the top portion 260 includes a protrusion 258 that helps to secure the bezel 214C within the skimmer 102, as discussed herein. In some embodiments, the orientation of the slot 254 and the tab 256 can be reversed such that the bottom portion 262 includes the protrusion 258. In some embodiments, the top portion 260 includes a slot 254 and a tab feature 256 that is adapted to connect with a corresponding tab feature 256 and slot 254 on the bottom portion 262. In some embodiments, the bezel 214 can include additional protrusions other than the protrusion 258 at the slot 254 to help hold the bezel 214 within the skimmer 102. For example, the bezel 214C shown in FIG. 17 can include one or more protrusions on the top outer surface 264 of the top portion 260. In some embodiments, the bezel 214 can include ribs 131 as described herein with regard to bezel 114.

Figure 18:
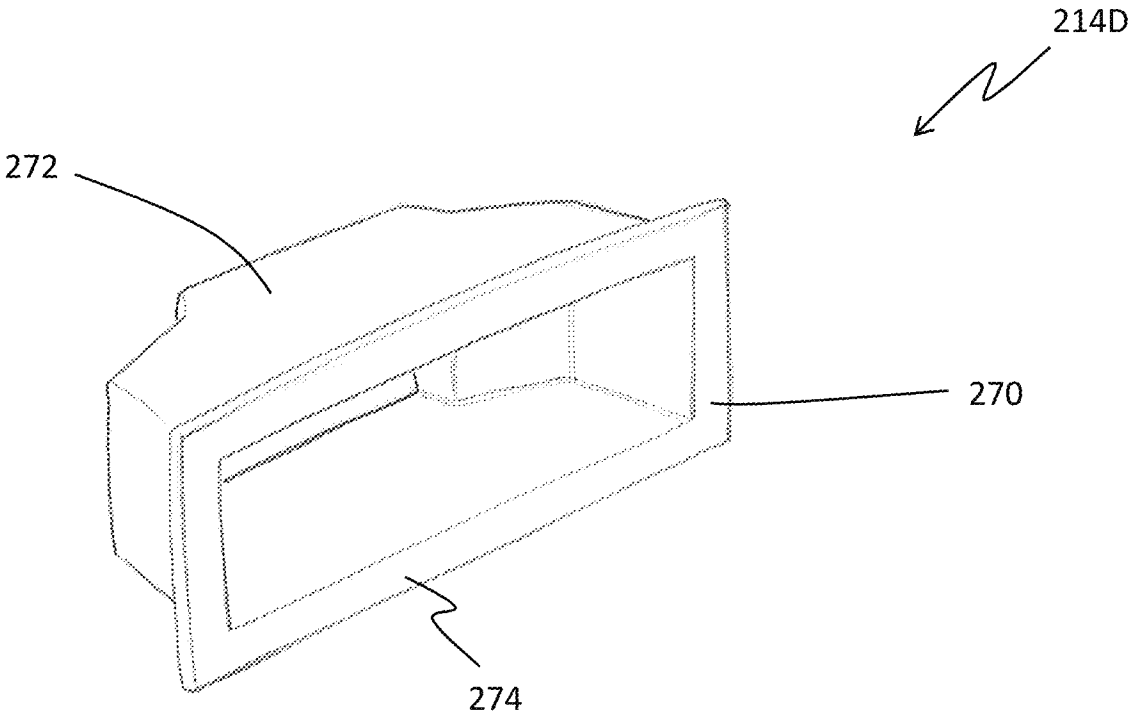
FIG. 18 illustrates a top perspective view of an embodiment of a bezel insert.

FIG. 18 illustrates an embodiment of the bezel 214D that is similar to the bezel 214C except as differently described herein. The bezel 214D can include a front frame 270 and a body portion 272. The front frame 270 can be a unitary structure with the body portion 272. In some embodiments, the front frame 270 can be attached to any of the bezel inserts 114, 214 previously described. In some embodiments, the front frame 270 can be attached to the bezel 214 by a slot and tab features described previously with regard to FIGS. 16 and 17. The front face 274 of the frame 270 can have a color or texture that matches the surrounding surface of the skimmer 102 or pool or spa in which the bezel 214D is installed.

CONCLUSION

Various embodiments and examples of assemblies have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

What is claimed is:

1. A bezel for inserting into an opening of a water skimmer installed in a wall of an artificial body of water, the bezel comprising:

an open-ended duct-like structure comprising a first wall, a second wall, a third wall, and a fourth wall, each of the first, second, third, and fourth walls having an inside surface that faces a central opening of the duct-like structure; and a first rib disposed on an outside surface of the first wall, the first rib extending a length along a direction from a front edge of the first wall to a rear edge of the first wall, the first rib extending a height away from the outside surface of the first wall, wherein the height of the first rib increases along the direction.

2. The bezel of claim 1, wherein the bezel has a color or a texture that mimics a surface of the wall of the artificial body of water.

3. The bezel of claim 1, wherein the outside surface of the first wall tapers toward the central opening along the direction.

4. The bezel of claim 1, wherein the outside surface of the first wall tapers towards the central opening along the direction by a first predetermined angle.

5. The bezel of claim 4, wherein the first predetermined angle is between 5 to 45°.

6. The bezel of claim 4, wherein the increase in the height of the first rib along the direction matches the first predetermined angle.

7. The bezel of claim 1, wherein the first rib is flush with the outer surface of the first wall at the front edge of the first wall.

8. The bezel of claim 1, wherein a trailing edge of the first rib is rounded.

9. The bezel of claim 1, further comprising a second rib that extends from an outside surface of a one of the second, third, and fourth walls.

10. The bezel of claim 9, wherein the outside surface of the one tapers towards the central opening along the direction by a second predetermined angle.

11. The bezel of claim 10, wherein the first predetermined angle is between 2 to 35°.

12. A bezel for inserting into an opening of a water skimmer installed in a wall of an artificial body of water, the bezel comprising:

a floor having a front edge, a back edge, a first lateral edge and a second lateral edge, the first and second lateral edges connecting the front edge to the back edge;

a first sidewall that extends in a first direction from the first lateral edge; and a second sidewall that extends in the first direction from the second lateral edge, the second sidewall comprising an inside surface that faces toward an inside surface of first sidewall, the floor comprising an inside surface that faces toward the first direction;

wherein the inside surfaces of the first sidewall, the second sidewall, and the floor has a color or a texture that mimics a surface of the wall of the artificial body of water.

13. The bezel of claim 12, wherein each of the first and second sidewalls comprises a first rail adapted to receive the lateral edge of the floor.

14. The bezel of claim 12, further comprising a top slab disposed opposite of the floor.

15. The bezel of claim 14, wherein each of the first and second sidewalls comprises a second rail adapted to receive a lateral edge of the top slab.

16. The bezel of claim 14, wherein the top slab comprises a protrusion disposed on the outside surface of the top slab, the protrusion sized to form a friction fit that holds the bezel within the opening of the skimmer.

17. The bezel of claim 14, further comprising a protrusion disposed on an outside surface of at least one of the first and second sidewalls, the protrusion sized to form a friction fit that holds the bezel within the opening of the skimmer.

18. The bezel of claim 14, wherein the top slab comprises a first opposing sidewall that extends in a second direction from a first lateral edge of the top slab and a second opposing sidewall that extends in the second direction from a second lateral edge of the top slab.

19. The bezel of claim 18, wherein the first opposing sidewall comprises a slot sized to receive a tab disposed on the first sidewall.

20. The bezel of claim 19, further comprising a protrusion disposed on an outside surface of the first opposing sidewall, the protrusion sized to form a friction fit that holds the bezel within the opening of the skimmer.

* * * * *